US007326318B2

(12) United States Patent
Strandqvist

(10) Patent No.: US 7,326,318 B2
(45) Date of Patent: Feb. 5, 2008

(54) HYDRAULICALLY ENTANGLED NONWOVEN MATERIAL AND METHOD FOR MAKING IT

(75) Inventor: Mikael Strandqvist, Lindome (SE)

(73) Assignee: SCA Hygiene Products AB, Gothenburg (SE)

( * ) Notice: Subject to any disclaimer, the term of this patent is extended or adjusted under 35 U.S.C. 154(b) by 508 days.

(21) Appl. No.: 10/400,673

(22) Filed: Mar. 28, 2003

(65) Prior Publication Data

US 2003/0213108 A1 Nov. 20, 2003

Related U.S. Application Data

(60) Provisional application No. 60/367,712, filed on Mar. 28, 2002.

(51) Int. Cl.
*D21H 11/00* (2006.01)

(52) U.S. Cl. ..... 162/109; 162/115; 162/146; 162/101; 162/110; 428/156; 428/170; 428/171; 428/172; 428/219; 428/220

(58) Field of Classification Search ..... 162/109, 162/115, 146, 110; 428/156, 170, 171, 172, 428/219, 220

See application file for complete search history.

(56) References Cited

U.S. PATENT DOCUMENTS

| | | | | |
|---|---|---|---|---|
| 4,970,104 | A * | 11/1990 | Radwanski | 428/32.21 |
| 6,163,943 | A | 12/2000 | Johansson et al. | |
| 6,315,864 | B2 * | 11/2001 | Anderson et al. | 162/109 |

FOREIGN PATENT DOCUMENTS

| | | |
|---|---|---|
| EP | 0 333 211 | 9/1989 |
| EP | 0 333 228 | 9/1989 |
| WO | WO 01/12888 | 2/2001 |
| WO | WO 01/88261 | 11/2001 |

* cited by examiner

*Primary Examiner*—Mark Halpern
(74) *Attorney, Agent, or Firm*—Young & Thompson

(57) ABSTRACT

A wetlaid or foam formed hydraulically entangled non-woven material containing at least 30%, by weight, pulp fibres and at least 20%, by weight, man-made fibres or filaments. The material has a basis weight variation in a non-random pattern in that it comprises a plurality of higher basis weight cushions protruding from one major surface of the material. The cushions as a main component comprise pulp fibres and are surrounded by a lower basis weight network which as a main component comprises the man-made fibres or filaments. The invention further refers to a method for making the material.

21 Claims, 4 Drawing Sheets

HYDRAULICALLY ENTANGLED NONWOVEN MATERIAL AND METHOD FOR MAKING IT

This application claims benefit of application 60/367,712 filed Mar. 28, 2002.

FIELD OF THE INVENTION

The present invention refers to a wetlaid or foam formed hydraulically entangled nonwoven material containing at least 30%, by weight, pulp fibers and at least 20%, by weight, man-made fibers. It further refers to a method of making such a material.

BACKGROUND OF THE INVENTION

Hydroentangling or spunlacing is a technique introduced during the 1970'ies, see e g CA patent no. 841 938. The method involves forming a fiber web, which is either drylaid or wetlaid, after which the fibers are entangled by means of very fine water jets under high pressure. Several rows of water jets are directed against the fiber, web which is supported by a movable wire. The entangled fiber web is then dried. The fibers that are used in the material can be natural fibers, especially cellulosic pulp fibers, man-made staple fibers, which may be synthetic, e g polyester, polyamide, polyethylene, polypropylene, or regenerated staple fibers, eg viscose, rayon, lyocell or the like, and mixtures of pulp fibers and staple fibers. Spunlace materials can be produced in high quality to a reasonable cost and they possess a high absorption capacity. They can e g be used as wiping material for household or industrial use, as disposable materials in medical care and in hygiene purposes etc.

Through e g EP-B-0 333 211 and EP-B-0 333 228 it is known to hydroentangle a fibrous mixture in which one of the fiber components is continuous filaments in the form of meltblown fibers.

In WO 96/02701 there is disclosed hydroentangling of a foam formed fibrous web. The fibers included in the fibrous web can be pulp fibers and other natural fibers and man-made fibers.

During the hydroentanglement the fiber web is supported either by a wire or a perforated, cylindrical metal drum. An example of a hydroentanglement unit of this kind is disclosed in for example EP-A-0 223 614. However, supporting members in the form of wires of the type utilised in connection with paper production is the most frequently occurring type as for example is shown in EP-A-0 483 816. One disadvantage with using wires of this type is that the fiber web, during the hydroentanglement, is exerted to a strong action by the water jets and will penetrate into and get caught between the wire threads. It may then be difficult to separate the final product from the wire.

WO 01/88261 discloses the use of a moulded, close-meshed screen of thermoplastic material as supporting member during hydroentanglement of a fibrous web. The removal of the final product from such screen is simplified as compared to a wire.

When making a nonwoven material, especially a material that is intended to be used as a wiping material, there a many properties that are important, such as absorptive capacity, absorption speed, wet strength, softness, drapability, low linting, high cleaning ability etc. It is however difficult to combine all these properties in one and the same material. It is for example possible to make cloth like, soft, strong and low linting hydroentangled nonwoven material by using 100% synthetic fibers. However the absorption properties of such a material will be low. Materials containing a high amount of pulp fibers have a high absorptive capacity, but a poor wet strength and high linting. The wet strength and linting properties can be improved by the addition of chemicals, such as wet strength agents and binders.

SUMMARY OF THE INVENTION

The object of the present invention is to provide a hydroentangled nonwoven material that combines properties like wet strength, absorptive capacity, softness and drapability. This has been achieved by a wetlaid or foam formed hydraulically entangled nonwoven material containing at least 30%, by weight, pulp fibers and at least 20%, by weight, man-made fibers or filaments, said nonwoven material having a basis weight variation in a non-random pattern in that it comprises a plurality of higher basis weight cushions protruding from one major surface of said material, said cushions as a main component comprises pulp fibers and are surrounded by a lower basis weight network which contains a relatively higher amount of man-made fibers or filaments as compared to the cushions.

It is believed that this specific structure provides:

- a cloth like appearance of the material;
- high strength due to the network of the man-made fibers;
- high absorptive capacity provided by the high pulp content cushions and the three-dimensional structure formed by these;
- high softness and drapability due to the plurality of bending indications provided by the network pattern.

The opposite major surface of the material is preferably substantially smooth. This will improve the capability of the material to wipe a surface dry from any remaining liquid.

The material preferably contains 40%, and more preferably at least 50%, by weight, pulp fibers. Preferably it contains at least 30%, and more preferably at least 40%, by weight, man-made fibers or filaments. The man-made fibers are in one embodiment staple fibers of a length between 6 mm and 25 mm.

It is preferred that the material has an absorptive capacity of at least 5 g/g water.

It is further preferred that the material has an absorption speed, WAT, in MD of no more than 1.5 s/m, preferably no more than 1 s/m, and in CD of no more than 2.5 s/m, preferably no more than 2 s/m.

In a preferred embodiment the cushions have a length and width between 0.2 and 4 mm, preferably between 0.5 and 2 mm. It is further preferred that the distance between the adjacent cushions is between 0.2 and 4 mm, preferably between 0.5 and 2 mm.

The present invention also refers to a method of producing a nonwoven material as stated above, said method comprises wetlaying or foamforming a fiber dispersion to form a fibrous web containing at least 30%, by weight, pulp fibers and at least 20%, by weight, man-made fibers or filaments, calculated on the total weight of the fibers in said fibrous web, and hydroentangling the fibrous web followed by subsequent dewatering and drying, wherein at least part of the hydroentangling step is performed on a foraminous support member in the form of a moulded, close-meshed screen of a thermoplastic material, said screen having apertures of the cross-dimensional size 0.2-4 mm the and the distance between the apertures being between 0.2-4 mm.

Preferably the apertures in said screen are of the size 0.5-2 mm and the distance between the apertures is between 0.5-2 mm.

In one embodiment the fibrous web is formed on a formation wire and is subjected to a first hydroentangling while supported on said formation wire, and is then transferred to said moulded, close-meshed screen where it is subjected to a further hydroentangling.

Preferably said further hydroentangling is performed from the opposite side of the fibrous web as compared to the first hydroentangling.

In a preferred embodiment the web is after dewatering subjected to non-compacting drying, such as through-air-drying, IR drying or the like. In order to maintain bulk and absorbency of the material preferably no pressing of the fibrous web takes place during dewatering and drying.

BRIEF DESCRIPTION OF THE DRAWINGS

The invention will below be described with reference to some embodiments described in the accompanying drawings.

DESCRIPTION OF EMBODIMENTS

Figure 1:
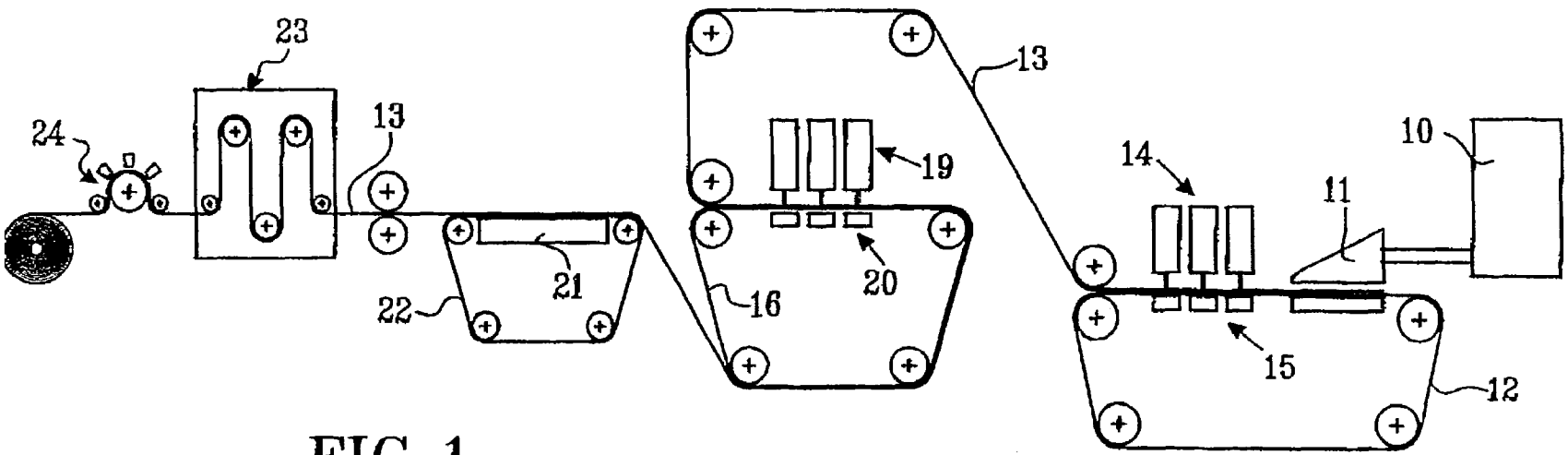
FIG. 1 is a schematic view of a device for hydroentangling a fibrous web.

The device, which schematically is shown in FIG. 1, for manufacturing a so-called hydroentangled or spunlaced material, comprises a vessel 10, e g a pulper, in which a wet or foamed fiber dispersion is prepared, which via a headbox 11 is distributed on a foraminous support member 12. This foraminous support member 12 is preferably a wire of any conventional kind used in papermaking industry and which is suited for formation and for a first hydroentangling step to intertwine at least the man-made fibers present in the web. The formed fibrous web 13 is then subjected to hydroentanglement from several rows of nozzles 14, from which water jets at a very high pressure are directed towards a fibrous web, while this is supported by the foraminous support member 12. The fibrous web is drained over suction boxes 15. Thereby, the water jets accomplish an entanglement of the fibrous web, i.e. an intertwining of the fibers. Appropriate pressures in the entanglement nozzles are adapted to the fibrous material, grammage of the fibrous web, etc. The water from the entanglement nozzles 14 is removed via the suction boxes 15 and is pumped to a water purification plant, and is then re-circulated to the entangling stations.

For a further description of the hydroentanglement or, as it is also called, spunlacing technology, reference is made e.g. to the above-mentioned CA patent No. 841 938.

The fibrous web 13 is either wet-laid or foam-formed. In a wet-laid process the fibers are dispersed in a liquid, normally water, in a similar way as in a papermaking process and the dilute fiber dispersion is deposited on the foraminous support member where it is dewatered to form a continuous web-like material. The fiber dispersion may be diluted to any consistency that is typically used in conventional papermaking process. A foam forming process is a variant of a wet-laying process and a surfactant is added to the fiber dispersion, which is foamed, and the foamed fiber dispersion is deposited on the foraminous support. A very even fiber distribution is achieved in a foam forming process and it is also possible to use longer fibers than in a conventional wet-laying process.

The fibers used to form the fiber dispersion is a mixture of cellulosic pulp fibers and man-made staple fibers or man-made filaments. The pulp fibers can be selected from any type of pulp and blends thereof. Preferably the pulp is characterized by being entirely natural cellulosic fibers and can include cotton as well as wood fibers. Preferred pulp fibers are softwood papermaking pulp, although hardwood pulp and non-wood pulp, such as hemp and sisal may be used. The length of pulp fibers may vary from less than 1 mm for hardwood pulp and recycled pulp, to up to 6 mm for certain types of softwood pulp. The fiber dispersion should contain at least 30% by weight, calculated on the total fiber weight, pulp fibers.

The man-made fibers may be any suitable synthetic fibers or regenerated cellulosic fibers. Examples of commonly used synthetic fibers are polyester, polyethylene, polypropylene, polyamide, polylactides and/or copolymers thereof. Examples of regenerated fibers are rayon, viscose, lyocell. The man-made fibers may be in the form of staple length fibers. A preferred length of staple fibers used in a wetlaying or foam forming process is between 6 mm and 25 mm. The fineness of the fibers can vary between 0.3 dtex and 6 dtex. The fibers dispersion should contain at least 20% by weight, calculated on the total fiber weight, man-made fibers.

The man-made filaments are preferably spunlaid or melt-blown filaments of suitable thermoplastic polymers, such as polyethylene, polypropylene, polyamides, polyesters and polylactides. Copolymers of these polymers may of course also be used, as well as natural polymers with thermoplastic properties.

Figure 2:
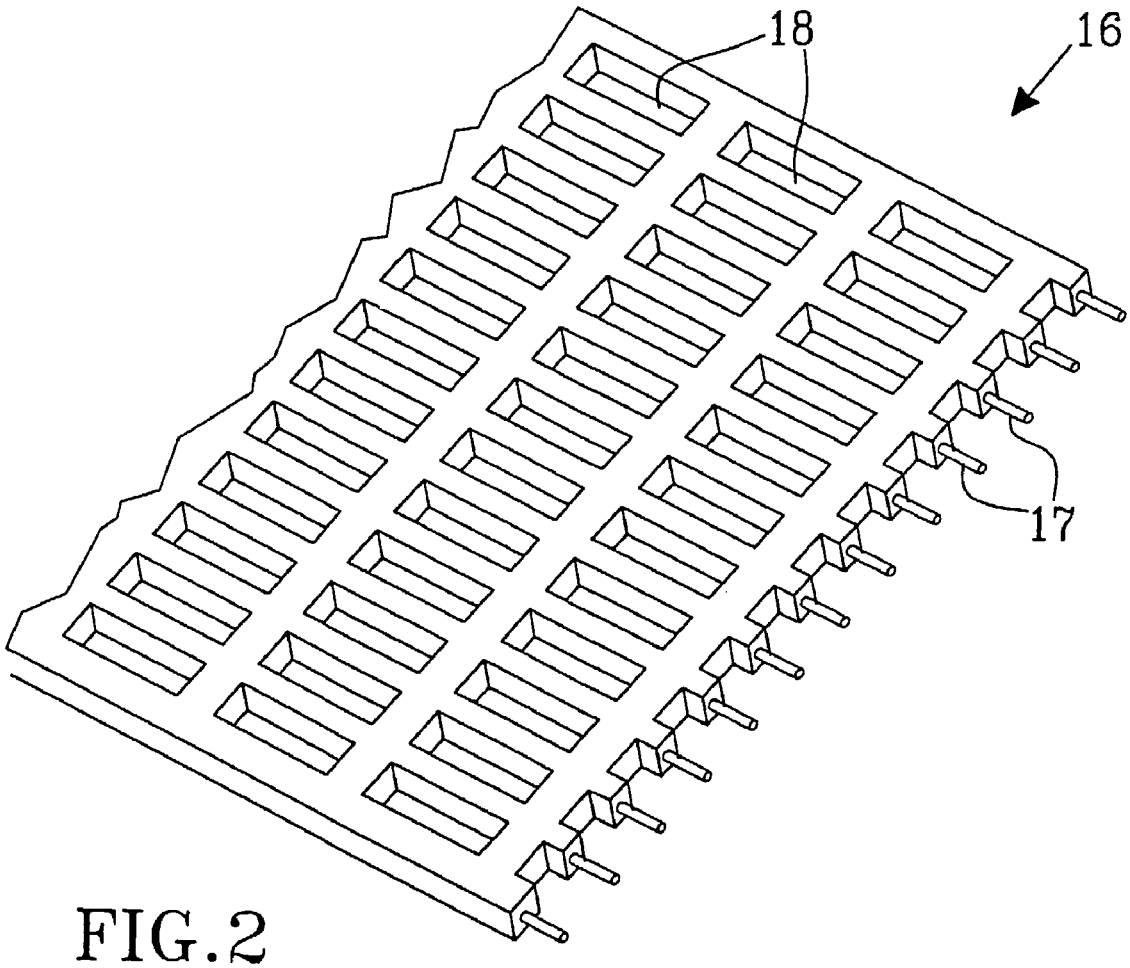
FIG. 2 shows a schematic perspective view, on an enlarged scale, of a screen used for supporting the fibrous web during the hydroentangling.

The web 13 is turned 180° and transferred to a second foraminous support member 16, which in a preferred embodiment is constituted of a moulded, close-meshed plastic screen, as disclosed in WO 01/88261. The plastic screen according to the invention can consist of one layer, as shown in FIG. 2, or of two or several layers applied on top of each other. Possibly, the screen can be reinforced with reinforcement wires 17 which extend in the intended machine direction of the plastic screen/entanglement wire 16. Reinforcement wires can be arranged also in the transverse direction of the screen, or both in the longitudinal and the transverse direction. The production of the plastic screen can take place e.g. in the way described in U.S. Pat. No. 4,740,409. The plastic screen is provided with a plurality of apertures 18, which will be described in greater detail below.

The web is hydroentangled a second time from several rows of nozzles 19 while supported on the plastic screen member 16. The second hydroentanglement takes place from the opposite side of the fibrous web 13 as compared to the first hydroentanglement. The fibrous web is drained over suction boxes 20.

Further dewatering of the fibrous web may take place over suction boxes 21, while the web 13 has been transferred to a dewatering wire 22. This further dewatering may optionally take place while the fibrous web is still supported by the plastic screen member 16.

The entangled material is then brought to a drying station 23 for drying before the finished material is reeled up and converted. Drying can be performed by blowing hot air through the fibrous web, by IR dryers or other non-compacting drying technique. Preferably no pressing of the fibrous web takes place during dewatering and drying thereof. The material may before conversion be exerted to different kind of treatments, such as corona or plasma treatment 24, treatment with chemicals of any desired kind etc. Corona or plasma treatment is preferably made after drying while chemicals may be added either to the fiber dispersion or after dewatering of the web by spraying printing or the like.

In the embodiments shown in FIG. 2, the apertures 18 in the screen 16 exhibit a rectangular shape, but it is evident that this shape can be varied to any geometrical shape. The meshes in the screen suitably exhibit an aperture size within the interval 0.2-4 mm, preferably 0.5-2 mm. The aperture size is herein defined as the size between opposite side edges or corners. The apertures are either of substantially the same size or of different sizes, and are either uniformly distributed across the screen or arranged to form patterns with alternating groups of apertures of different sizes. Also the cross-sectional shape of the apertures in the z-direction can be varied, and can be e.g. substantially rectangular, alternatively convex or concave. The distance between the apertures may vary between 0.2-4 mm, preferably between 0.5 and 2 mm. The distance between the apertures is defined as the shortest distance between adjacent apertures.

In case the screen consists of two or several layers arranged on top of each other, the different layers can exhibit different aperture sizes among themselves, e.g. with larger apertures in an upper layer and smaller apertures in a lower layer. This is shown in WO 01/88261. In this way, fibers can penetrate down into the larger apertures in the upper layer but be retained by the lower layer during the entanglement.

The surface, which is intended to support the fibrous web, can be substantially smooth, or exhibit a three-dimensional structure in order to impart a corresponding three-dimensional structure to the hydroentangled material.

Other foraminous supports such as wires and other types of screens may also be used, which have apertures of the size stated above.

When hydroentangling the fiber dispersion through the apertured screen 16 the shorter pulp fibers, which are more easily mobile, will to a higher extent follow the water that is drained through the apertures 18 and be accumulated in said apertures, while the longer man-made fibers which are less mobile and more easily intertwined by the water jets, will to a higher extent stay in place on the screen 16 and build up a strong fibrous network.

This will result in a nonwoven material having a plurality of cushions 25 protruding from one major surface of the material, said cushions as a main component comprise pulp fibers 26 that during drainage have accumulated in the apertures 18 of the screen 16. The term "main component" in this respect means that more than 50% by weight, preferably more than 60% by weight and more preferably more than 70% by weight of the fibers present in said cushions are pulp fibers 26. A minor proportion of the fibers in the cushions 16 will of course be man-made fibers.

Figure 3:
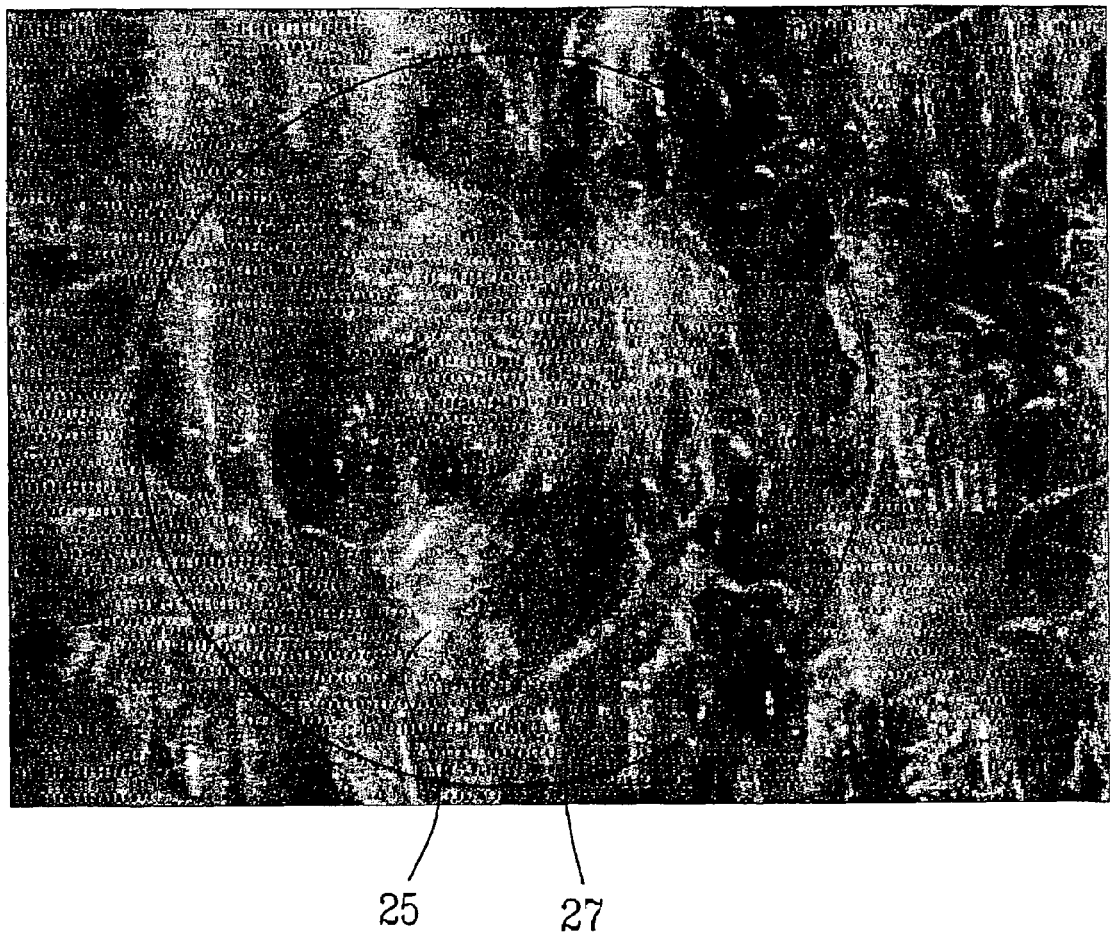
FIG. 3 is a picture taken of a nonwoven material according to the invention on a magnification of about 30 times.
Figure 4:
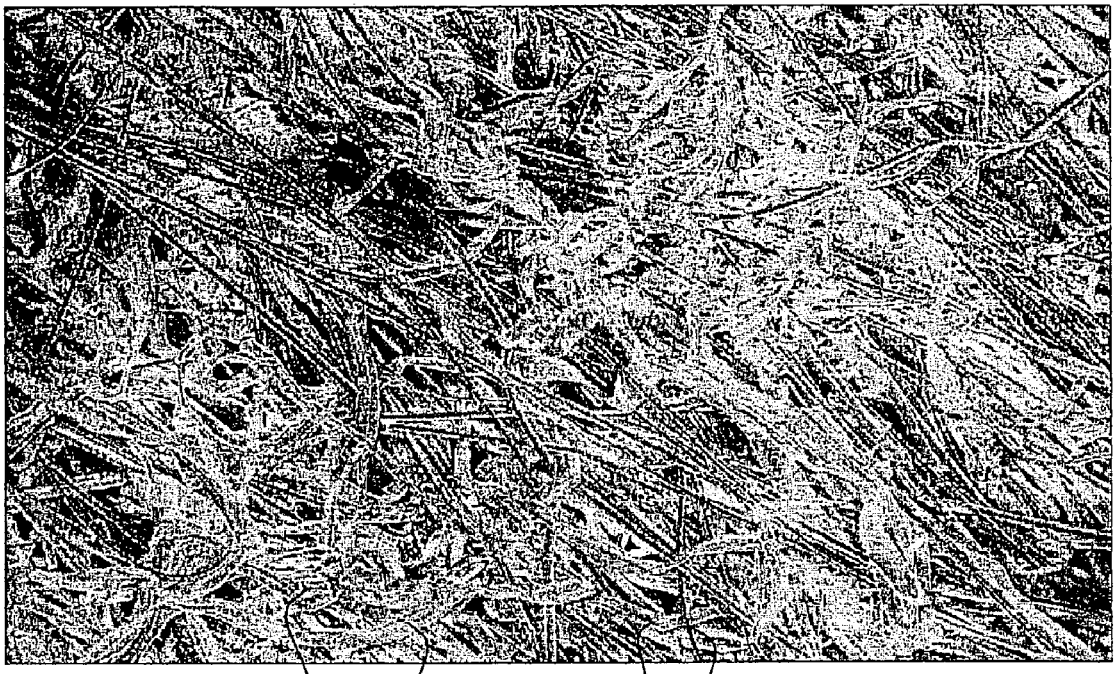
FIGS. 4 and 5 are electron microscope (SEM) pictures of a nonwoven material according to the invention.
Figure 5:
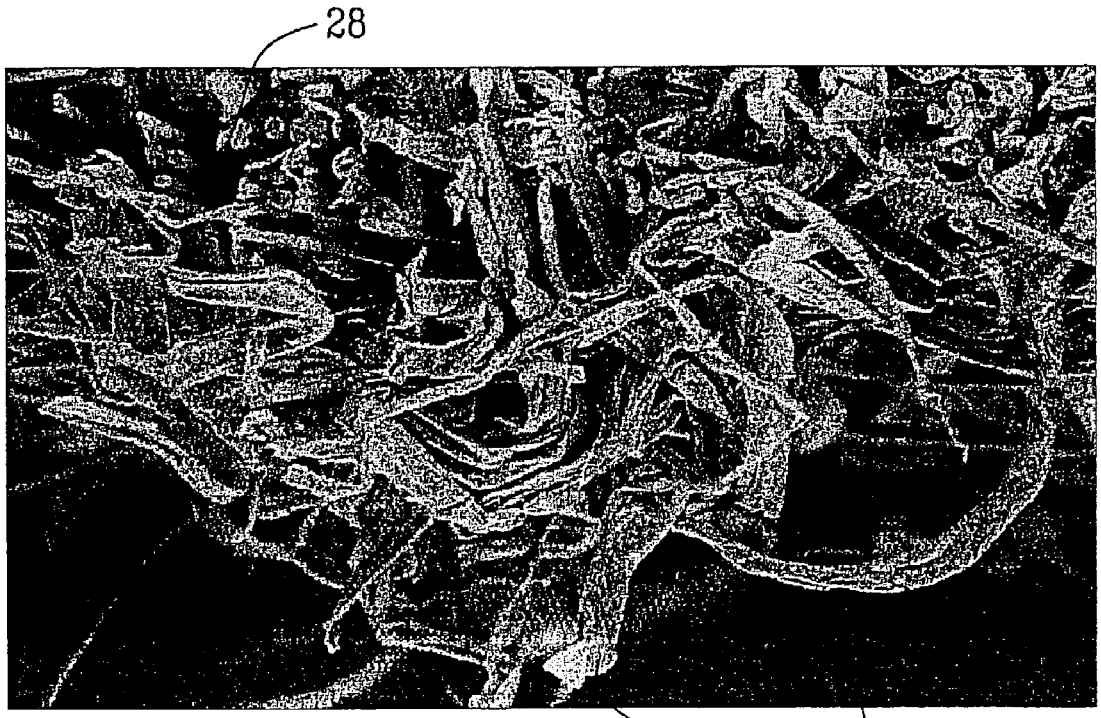

The pulp fiber cushions 25 are surrounded by a network 27, which contains a relatively higher amount of man-made fibers 28 as compared to the cushions 25. In a preferred embodiment more than 50% by weight, preferably more than 60% by weight and more preferably more than 70% by weight of the fibers present in said network are man-made fibers 28. The longer man-made fibers 28 are more easily entangled and will intertwine with each other to form a strong continuous network 27 which will impart high strength to the material. The pulp fiber cushions contribute to the absorbency of the material. This is shown in FIGS. 4 and 5 showing SEM-pictures of a material according to the invention, and in which the accumulation of pulp fibers 26 to form the cushions 25 can be seen. It is further seen how these cushions 25 are surrounded by a network. This is also seen from the light microscope picture in FIG. 3.

In order to provide a pronounced cushion effect at least 30% by weight and preferably at least 40% of the fibers in the material should be pulp fibers and in order to provide a strong network of man-made intertwined fibers at least 20% by weight and preferably at least 30% by weight of the fibers in the material should be man-made fibers.

The length and width dimensions of the cushions 25 will correspond to the size of the apertures 18 of the screen 16 and the width of the network strands 27 between the cushions 25 will correspond to the distance between adjacent apertures 18 of the screen 16.

The opposite major surface of the material is preferably substantially smooth as compared to the first surface having a pronounced three-dimensional structure provided by the plurality of protruding cushions. This gives the material a two-sidedness with one side that is more "rough" and adapted to remove and capture liquids, viscous fluids and solid particles from a surface. The opposite smooth surface is adapted to wipe a surface dry from liquid.

Tests have been performed on materials produced as described below.

A foamformed fiber dispersion was made from water, surfactant and a mixture of pulp fibers and man-made staple length fibers. A surfactant was added to the water in an amount of 0.03% by weight. The foamed fiber dispersion was laid on a wire and the formation was made at an air content in the foam of 30-50% by volume. The fibrous web was hydroentangled on the same wire used for formation. The web was then transferred to a moulded, close-meshed plastic screen as disclosed above, having holes of the size 0.89×0.84 mm and a distance between the holes of 0.46 mm. The web was then hydroentangled from the opposite side. The main part of the hydroentangling was made on the first wire in order to give maximum strength to the material. The total energy supply at the hydroentangling was about 200 kWh/ton material.

The fibrous web was then dewatered by vacuum suction boxes and dried by so called through-air-drying (TAD).

The fibers used for forming the fibrous web had the following composition:

| | |
|---|---|
| Ex. 1: | 25 wt % polyester (PET) from KoSa, 1.7 dtex/19 mm;<br>17 wt % polypropylene (PP) from Fibervisions, 1.7 dtex/18 mm;<br>58 wt % bleached sulphate pulp fibers from Korsnäs, Vigor Fluff. |
| Ex. 2: | 40 wt % polypropylene (PP) from Fibervisions, 1.7 dtex/18 mm;<br>50 wt % bleached sulphate pulp fibers from Korsnäs, Vigor Fluff. |

As reference material was used a nonwoven wiping material produced by SCA Hygiene Products AB under the trade mark E-Tork Strong™. It is made by wet forming a fiber mixture and hydroentangling thereof. However there is not used any moulded, close-meshed plastic screen, but the hydroentangling process is performed on a conventional papermaking wire. The material does not have the patterned three-dimensional structure as claimed by the present invention, but a more uniform fiber distribution. The fiber composition in the reference material was as follows:

Ref.: 25 wt % polyester (PET) from KoSa, 1.7 dtex/19 mm;
17 wt % polypropylene (PP) from Steen, 1.7 dtex/18 mm;
58 wt % bleached sulphate pulp fibers from Korsnäs, Vigor Fluff.

Thus the fiber composition is the same as for Ex. 1 except that the PP fibers are from another manufacturer.

Evaluations concerning strength properties both in dry and wet conditions, absorbency, wicking rate were performed and gave the results presented in Table 1 below:

TABLE 1

| | | Ex. 1 | Ex. 2 | Ref. |
|---|---|---|---|---|
| Grammage | $g/m^2$ | 76.4 | 88.0 | 83.0 |
| Thickness | μm | 623 | 641 | 357 |
| Bulk 2 kPa | $cm^3/g$ | 8.2 | 7.3 | 4.3 |
| Tensile stiffness MD | N/m | 30230 | 38385 | 57518 |
| Tensile stiffness CD | N/m | 2096 | 6488 | 6689 |
| Tensile stiffness index | Nm/g | 104 | 179 | 236 |
| Tensile strength MD, dry | N/m | 3126 | 3061 | 1499 |
| Tensile strength CD, dry | N/m | 672 | 745 | 630 |
| Tensile index, dry | Nm/g | 19 | 17 | 12 |
| Stretch MD | % | 28 | 33 | 13 |
| Stretch CD | % | 71 | 45 | 44 |
| Stretch sq root(MDCD) | % | 45 | 39 | 24 |
| Work to rupture MD | $J/m^2$ | 647 | 714 | 251 |
| Work to rupture CD | $J/m^2$ | 347 | 238 | 261 |
| Work to rupture index | J/g | 6 | 5 | 3 |
| Tensile strength MD, water | N/m | 2066 | 3028 | 568 |
| Tensile strength CD, water | N/m | 330 | 619 | 185 |
| Tensile index, water | Nm/g | 10.8 | 15.6 | 3.9 |
| Relative strength, water | % | 57 | 91 | 33 |
| Tensile str. MD, surfactant | N/m | 1536 | 3002 | 407 |
| Tensile str. CD, surfactant | N/m | 330 | 647 | 122 |
| Tensile index, surfactant | Nm/g | 9.3 | 18.2 | 2.5 |
| Rel. strength, surfactant | % | 49 | 96 | 15 |
| Absorption DIN, water | g/g | 6.0 | 5.1 | 3.9 |
| Absorption speed WAT, x-dir. (CD) | s/m | 0.4 | 0.7 | 1.7 |
| Absorption speed WAT, y-dir. (MD) | s/m | 0.8 | 1.3 | 2.7 |
| Wet linting | part./$m^2$ | 397 | 228 | 259 |

The tensile stiffness, tensile strength, work to rupture and stretch were measured according to the test method SCAN-P44:81.

The absorption DIN was measured according to the test method DIN 54 540, part 4, with the modification that the sample was suspended vertically during soaking and not in horizontal position as in the standard method.

The absorption speed WAT was measured according to the test method SCAN-P 62:88. However the following modification of the sample was made: Instead of aiming for a total grammage of between 100 and 150 $g/m^2$ of the sample sheaf, we have aimed for a total thickness of 1 mm. No measurements of the absorption speed in z-direction were made.

These results show superior strength properties both in dry and wet conditions for the nonwoven materials according to the invention. This is believed to be due to the strong network that is created by the man-made fibers present in the material, said network being more or less continuous. The choice of man-made fibers also plays an important role for the strength of the material, and it is seen from the test results that Ex. 2 which contains 40% by weight polypropylene fibers (1.7 dtex/18 mm), has improved strength properties as compared to Ex. 1 containing a mixture of polyester and polypropylene, 25% polyester (1.7 dtex/19 mm) and 17% polypropylene fibers (1.7 dtex/18 mm). However both materials have considerably higher strengths, i.e. tensile strength (dry, water, surfactant), stretch and work to rupture, as compared to the reference material.

The materials according to the invention are less stiff than the reference material.

The materials according to the invention further have improved absorption properties, both total absorbency and absorption or wicking speed (WAT), as compared to the reference material. This is believed to be due to a combination of the high concentration of pulp fibers present in the plurality of cushions protruding from one side of the material, said cushions of pulp fibers being capable of absorbing and holding liquid, and the network of predominantly man-made fibers, said network being adapted to distribute the liquid in the material.

The invention claimed is:

1. A wetlaid or foam formed hydraulically entangled nonwoven material containing at least 30%, by weight, pulp fibers and at least 20%, by weight, man-made fibers or filaments, wherein said nonwoven material has a basis weight variation in a non-random pattern and comprises a plurality of higher basis weight cushions protruding from one major surface of said material, said cushions as a main component comprising pulp fibers and being surrounded by a lower basis weight network which contains a relatively higher amount of man-made fibers or filaments as compared to the cushions.

2. The nonwoven material as claimed in claim 1, wherein the opposite major surface of the material is substantially smooth.

3. The nonwoven material as claimed in claim 1, wherein said nonwoven material contains at least 40%, by weight, pulp fibers.

4. The nonwoven material as claimed in claim 1, wherein said woven material contains at least 30%, by weight, man-made fibers or filaments.

5. The nonwoven material as claimed in claim 1, wherein said man-made fibers are staple fibers of a length between 6 mm and 25 mm.

6. The nonwoven material as claimed in claim 1, wherein said nonwoven material has an absorptive capacity of at least 5 g/g water.

7. The nonwoven material as claimed in claim 1, wherein said nonwoven material has an absorption speed, WAT, in MD of no more than 1.5 s/m and in CD of no more than 2.5 s/m.

8. The nonwoven material as claimed in claim 7, wherein said nonwoven material has an absorption speed, WAT, in MD of no more than 1 s/m and in CD of no more than 2 s/m.

9. The nonwoven material as claimed in claim 1, wherein a width of strands of the network between adjacent cushions is between 0.2 and 4 mm.

10. The non-woven material as claimed in claim 1, wherein the cushions have a length and width between 0.5 and 2 mm, and a width of strands of the network between adjacent cushions is between 0.5 and 2 mm.

11. A wetlaid or foam formed hydraulically entangled nonwoven material containing at least 30%, by weight, pulp fibers and at least 20%, by weight, man-made fibers or filaments, wherein said nonwoven material has a basis weight variation in a non-random pattern and comprises a plurality of higher basis weight cushions protruding from one major surface of said material, said cushions as a main component comprising pulp fibers and being surrounded by a lower basis weight network which contains a relatively higher amount of man-made fibers or filaments as compared to the cushions, wherein said cushions have a length and width between 0.2 and 4 mm.

12. The nonwoven material as claimed in claim 11, wherein the opposite major surface of the material is substantially smooth.

13. The nonwoven material as claimed in claim 11, wherein said nonwoven material contains at least 40%, by weight, pulp fibers.

14. The nonwoven material as claimed in claim 11, wherein said woven material contains at least 30%, by weight, man-made fibers or filaments.

15. The nonwoven material as claimed in claim 11, wherein said man-made fibers are staple fibers of a length between 6 mm and 25 mm.

16. The nonwoven material as claimed in claim 11, wherein said nonwoven material has an absorptive capacity of at least 5 g/g water.

17. The nonwoven material as claimed in claim 11, wherein said nonwoven material has an absorption speed, WAT, in MD of no more than 1.5 s/m and in CD of no more than 2.5 s/m.

18. The nonwoven material as claimed in claim 17, wherein said nonwoven material has an absorption speed, WAT, in MD of no more than 1 s/m and in CD of no more than 2 s/m.

19. The nonwoven material as claimed in claim 11, wherein a width of strands of the network between adjacent cushions is between 0.2 and 4 mm.

20. The nonwoven material as claimed in claim 11, wherein the cushions have a length and width between 0.5 and 2 mm, and a width of strands of the network between adjacent cushions is between 0.5 and 2 mm.

21. The nonwoven material as claimed in claim 11, wherein said cushions have a length and width between 0.5 and 4 mm.

* * * * *